United States Patent [19]

Conrads et al.

[11] Patent Number: 4,476,793

[45] Date of Patent: Oct. 16, 1984

[54] EMBROIDERY MACHINE

[75] Inventors: Hans Conrads, Tönisvorst; Josef Hoffmans, Geldern; Hans Hippel; Hubert Hoven, both of Krefeld; Hans Rolaussf; Max Schäfer, both of Krefeld, all of Fed. Rep. of Germany

[73] Assignee: Maschinenfabrik Karl Zangs AG, Krefeld, Fed. Rep. of Germany

[21] Appl. No.: 325,620

[22] Filed: Nov. 30, 1981

[30] Foreign Application Priority Data

Dec. 19, 1980 [DE] Fed. Rep. of Germany ..... 3047928

[51] Int. Cl.[3] ..... D05B 55/16

[52] U.S. Cl. ..... 112/221; 112/79 A; 112/98

[58] Field of Search ..... 112/221, 220, 84, 98, 112/79 A, 79 R, 163

[56] References Cited

U.S. PATENT DOCUMENTS

| | | | |
|---|---|---|---|
| 3,502,044 | 3/1970 | Brown et al. | 112/221 X |
| 3,695,199 | 10/1972 | Rolauffs et al. | 112/221 |
| 4,089,281 | 5/1978 | Landoni | 112/221 |
| 4,301,756 | 11/1981 | Teetz et al. | 112/221 |

*Primary Examiner*—Peter P. Nerbun

*Attorney, Agent, or Firm*—Holman & Stern

[57] ABSTRACT

An embroidery machine having a plurality of embroidery bars, particularly needle and piercer bars, which are mounted for axial displacement independently of each other and arranged in at least one row alongside of each other, which bars can be coupled individually with a reciprocating drive element in accordance with a program determined by a control. In order to be able to couple each individual embroidery bar with the drive element in accordance with any desired unlimited number of programs without having to stop the drive in order to change the program, each individual embroidery bar can be coupled with the drive element by the force of at least one magnet.

20 Claims, 10 Drawing Figures

EMBROIDERY MACHINE

The present invention relates to an embroidery machine having a plurality of embroidery bars, particularly needle and piercer bars, which are mounted for axial displacement independently of each other and arranged in at least one row alongside of each other, the bars being adapted to be coupled individually with a reciprocating drive element in accordance with a program determined by a control.

Embroidery machines of the above-mentioned type are known, for instance, in a form of shuttle embroidery machines having a pattern-repeat and color-change device, the change of the needle bars coupled at the time to the reciprocating drive element being effected by a control shaft which is rotatably supported in the frame of the shuttle embroidery machine. This control shaft is provided on its periphery with several rows of elevations or depressions which via mechanical coupling members, for instance spring-loaded pawls, effect the connection and disconnection of individual needle bars to and from the drive elements. By the turning of the control shaft different needle bars can be disconnected or else used for the embroidery process respectively.

The known embodiments of such repeat and color-change devices on shuttle embroidery machines have the disadvantage that, on the one hand, the number of programs which can be stored on a control shaft is very limited and that, on the other hand, a change in program takes a relatively long period of time since the control shaft must be turned in order to effect a change in program and this must be done up to an angle of rotation of 180°. Since this further movement of the control shaft for the change of the program cannot be carried out within one operating stroke of the needle bars, it is necessary, in the known embodiments, to stop the needle-bar drive of the shuttle embroidery machine in order to change a program.

The object of the invention is to create an embroidery machine of the above-mentioned type, particularly a shuttle embroidery machine, in which individual embroidery bars can be connected to the reciprocating drive element in accordance with any desired unlimited number of programs without it being necessary to stop the drive of the embroidery bars in order to change the program.

The manner in which this object is achieved by the invention is characterized by the fact that each individual embroidery bar (4) can be coupled to the drive element (9) by the force of at least one magnet (11, 12, 13, 15, 20, 21, 24).

By the use in each case of at least one magnet for coupling the individual embroidery bars to the drive element, not only is the previous limitation overcome with respect to the number of programs which can be stored, but also the necessity, upon a change in program, of stopping the drive element which moves the embroidery bars back and forth is overcome as well. These improvements are obtained since, on the one hand, the storage possibilities for the control of the individual magnets are practically unlimited and, on the other hand, the control of the magnets can be effected within a very short period of time so that a change of program can be carried out within one operating stroke of the embroidery bars. The embroidery machine of the invention, whose embroidery bars may be arranged either in the manner of a shuttle embroidery machine with one or more rows of adjacent needle and piercer bars or alongside of and above each other in a surface covering manner, thus makes it possible to perform a practically unlimited number of programs with simultaneous increase of output and reduction in cost of construction.

In accordance with another feature of the invention, the magnets which are associated in each case with an embroidery bar can be arranged directly between a part of the embroidery bar and the drive element and, as a matter of fact, optionally on the drive element or on the embroidery bar respectively. Furthermore, in accordance with the invention it is possible to develop the magnets either as electric magnets or as controllable permanent magnets. While each electromagnet is, in accordance with the invention, connected electrically at all times with the program control, the permanent magnets can be controlled with the program control in the end position of rest of the embroidery bar. This can be done—in accordance with another feature of the invention—by eliminating the magnetic holding force of the permanent magnet, for purposes of reversal, by an oppositely directed magnetic field.

In one preferred embodiment of the invention, an induction coil which at least partially surrounds the permanent magnet is arranged on the permanent magnet, and is adapted to be energized in the end position of rest of the embroidery bar so that the magnetic holding force of the permanent magnet can be eliminated for a short time during the switching process by an oppositely directed magnet field. The connection of the induction coil arranged on the permanent magnet can be effected by pairs of contacts, one of which is arranged on the moving induction coil while the other is fixed on the frame of the embroidery machine so that energization of the induction coil and thus switching of the permanent magnet are possible only in the end position of rest of the embroidery bar.

In another possible embodiment of the invention, an induction coil which at least partially surrounds the permanent magnet in its position of rest is arranged fixed in position. In this case, the permanent magnet enters into the stationary induction coil solely in the end position of rest so that only in this position can it be switched via the induction coil which is energized in accordance with the program.

Instead of arranging the magnets which are developed either as electromagnets or permanent magnets directly between a part of the embroidery bar and the drive element, each embroidery bar can—in accordance with another feature of the invention—be adapted to be coupled to the drive element by a mechanical coupling element which in its turn can be actuated by a magnet. In this case also the magnet may be either an electromagnet or a controllable permanent magnet. In this further development of the invention, although a larger number of structural elements are required for the coupling process due to the use of mechanical coupling elements, the mechanical coupling elements, however, permit form-locked driving (complementary shape connection) of the embroidery bars by the drive element in both directions of movement. In this way, for instance, with tightly embroidered material or in case of heavy threads, the necessary holding force between the drive element and the embroidery bar is guaranteed and the possibility is created of using magnets which are as small and economical as possible in order to control the mechanical coupling element. In one preferred embodiment, the magnet may have an armature part which is stable in both end positions and by which the mechanical coupling element can be actuated. In this case also, the magnets may be arranged either on the drive element or on the embroidery bars. It is also possible, in accordance with the invention, to arrange one magnet fixed in position on the machine frame for each embroidery bar, each of these magnets actuating the mechanical coupling element in the end position of rest of the corresponding embroidery bar.

In order to keep the number of control lines as small as possible when there is a larger number of magnets to be controlled, it is proposed, by the invention, to connect a plurality of induction coils to the source of energy via a common energy line and to associate with each induction coil a frequency-dependent circuit having a response frequency of its own which differs from that of the other circuits and which circuit controls the energization of the associated induction coil in accordance with a frequency spectrum which is sent out by the program control over a control line which is common to all circuits. The induction coil can in this case be the energizing coil of an electromagnet or the control coil for the switching of a permanent magnet. In both cases one energy line and one control line are sufficient to actuate all magnets of the embroidery machine, for instance more than one thousand magnets of a shuttle embroidery machine.

A further reduction can finally be obtained in accordance with the invention by connecting the induction coils to the program control by means of a single common energy and control line, the frequency spectrum employed for control purposes being superimposed on the energy fed.

With the above and other objects and advantages in view, the present invention will become more clearly understood in connection with the detailed description of preferred embodiments, when considered with the accompanying drawings, of which:

Figure 1:
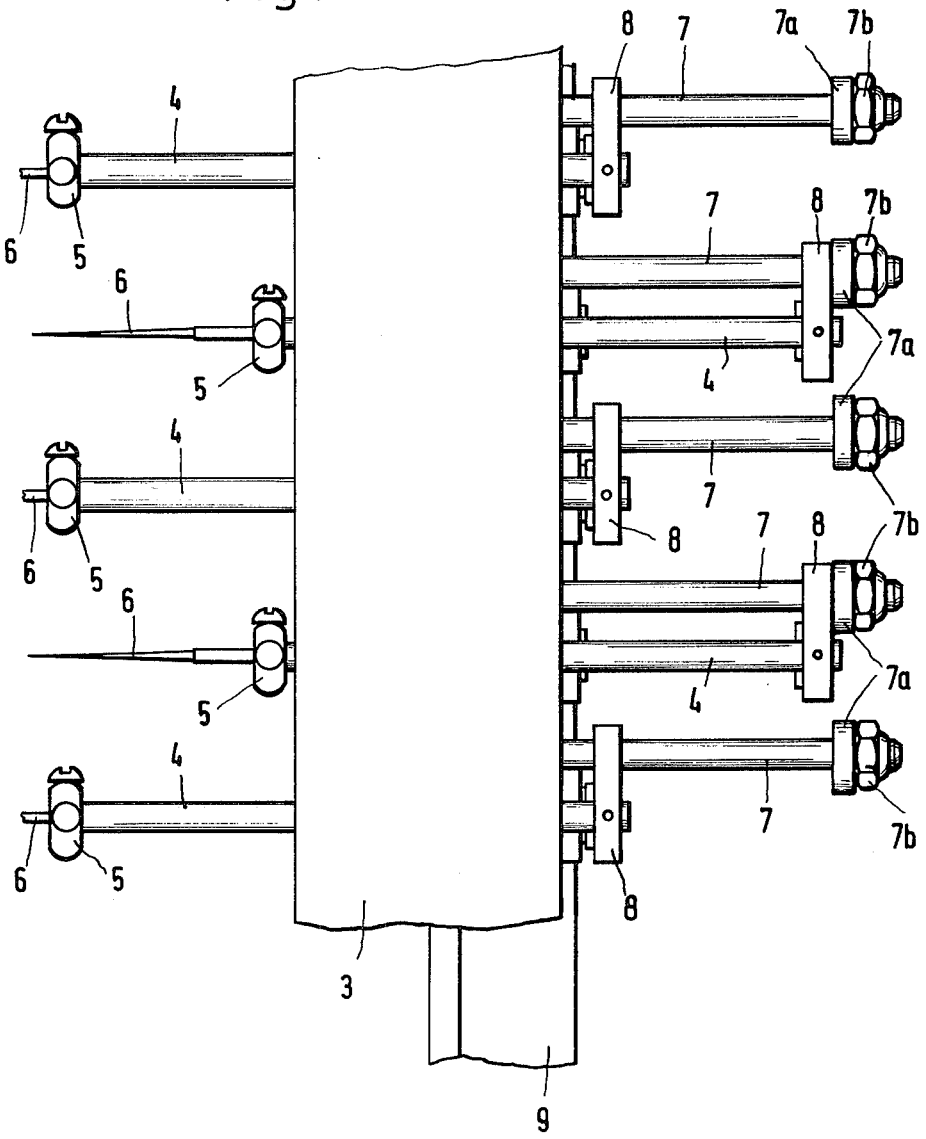
FIG. 1 is a top view of a part of a first embodiment of the embroidery machine.
Figure 2:
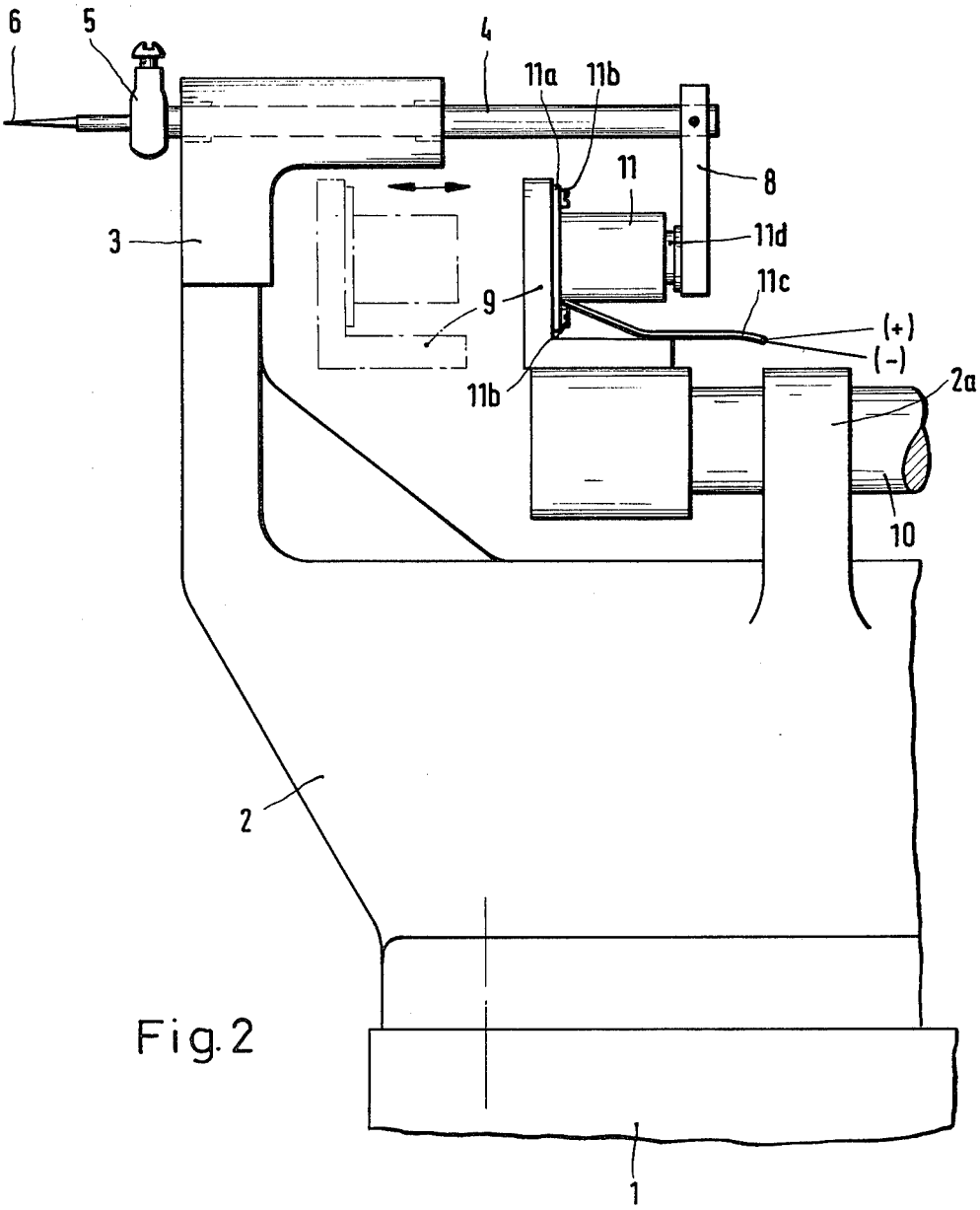
FIG. 2 is a side view of FIG. 1.

Of the embroidery machine of the first embodiment which is developed as shuttle embroidery machine, FIGS. 1 and 2 show only a front portion of the machine frame 1 on which a needle support 3 is fastened via supporting brackets 2. On this needle support 3, a part of which can be noted in the top view of FIG. 1, there are supported a plurality of needle bars embroidery bar 4 which are axially displaceable independently of each other and arranged alongside of each other in a row. Each of these needle bars 4 in the embodiment shown bears at its front end a clamping head 5 to which a needle 6 is fastened.

On the rear end of the needle support 3, parallel to each needle bar 4, there are fastened guide bars 7 which are of circular cross section as are the needle bar 4. On each of these guide bars 7 there is displaceably guided in axial direction a guide plate 8 which is fastened to the rear end of the corresponding needle bar 4. In this way additional guidance is obtained for the needle bars 4 as well as assurance against the twisting thereof. Each guide bar 7 bears at its rear end a holding magnet **7*a* which is fastened adjustably by an adjustment nut 7*b* on the guide bar 7 and which, in the rear-end position of the needle bar 4, holds the needle bar fast via the corresponding guide plate 8 when the corresponding needle 6** is not to participate in the embroidery process.

The driving of the needle bars 4 which are desired for embroidery at the time is effected by a drive element developed as drive rail 9 which is formed in angular shape as seen in cross section in the embodiments of FIGS. 1 and 2 and is fastened to at least two drive rods 10 which are reciprocated back and forth. These drive rods 10, one of which can be noted in FIG. 2, are guided in bearing pedestals **2*a* of the supporting brackets 2. While in FIG. 2 the drive rail 9 is shown in solid line in its rear-end position, FIG. 1 shows the drive rail 9 in its front-end position, which is indicated in dot-dash line in FIG. 2**.

The driving of the needle bar 4 selected in each case for the embroidery process is effected, in the embodiment of FIGS. 1 and 2, by a magnet 11 which has its base plate **11*a* fastened by screws 11*b* to the drive rail 9, as can be noted from FIG. 2. The magnet 11, which is developed an electromagnet, is permanently electrically connected via a two-wire line 11*c* with the program control of the embroidery machine so that its coil can be energized at any time when needed. The magnetic holding force produced upon the energization of the magnet coil results in a coupling of the corresponding needle bar 4 via the guide plate 8 and the core 11*d* of the magnet with the drive rail 9 so that the needle bar 4 participates in the reciprocation of the drive rail 9. If the needle bar 4 is to be disconnected from the drive rail 9, the energization of the magnet 11 is terminated in the end rest position of the drive rail 9 shown in solid line in FIG. 2. In this case, the magnet 11 moves with the drive rail 9 without carrying the guide plate 8 along with it, the latter being rather held fast in the end position of rest by the corresponding holding magnet 7*a* on the parallel guide bar 7, as is shown on two needle bars 4 in the top view of FIG. 1**.

Figure 3:
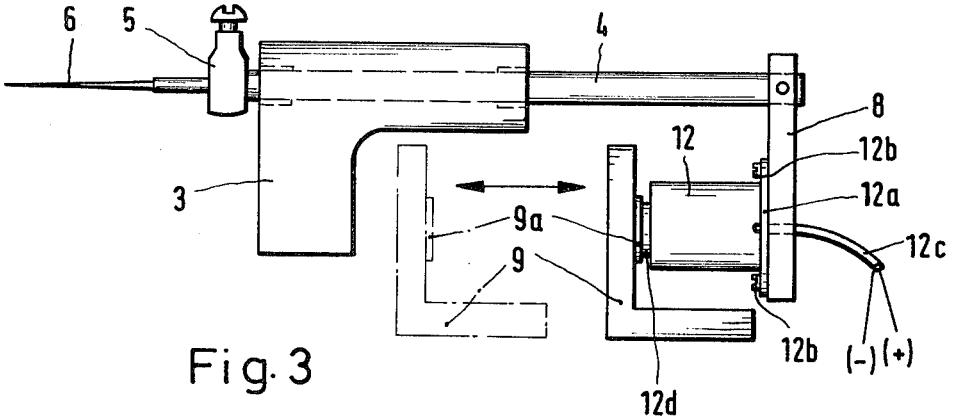
FIG. 3 is a diagrammatic side view of a second embodiment.

In the second embodiment, shown in FIG. 3, there is also a direct coupling of the needle bar 4, which is selected for the specific embroidery process, with the drive element developed as drive rail 9 by the force of a magnet 12. This magnet 12, which is also developed as an electromagnet, has its base plate **12*a* fastened by screws 12*b*—as shown in FIG. 3—to the guide plate 8 corresponding to the respective needlebar 4. The coil of the magnet 12 is permanently electrically connected via a two-wire line 12*c* with the program control (not shown in the drawing) of the embroidery machine so that, upon energization of the magnet 12, its core 12*d* is coupled directly with the drive rail 9. In order to increase the holding force, the drive rail 9 can be provided, in the region of the core 12*d* of each magnet 12, with a counterplate 9*a* for the core 12*d* of the magnet 12** so that it is possible, for instance, to make the drive rail 9 of a non-magnetic material, for instance aluminum. As compared with the first embodiment, shown in FIGS. 1 and 2, the embodiment of FIG. 3 has the advantage that the disconnected magnets 12 do not participate in the reciprocation of the drive rail 9 but remain in the rear end position of rest together with the guide plates 8 of the disconnected needle bars 4, as a result of which the weight which is reciprocated is reduced.

Figure 4:
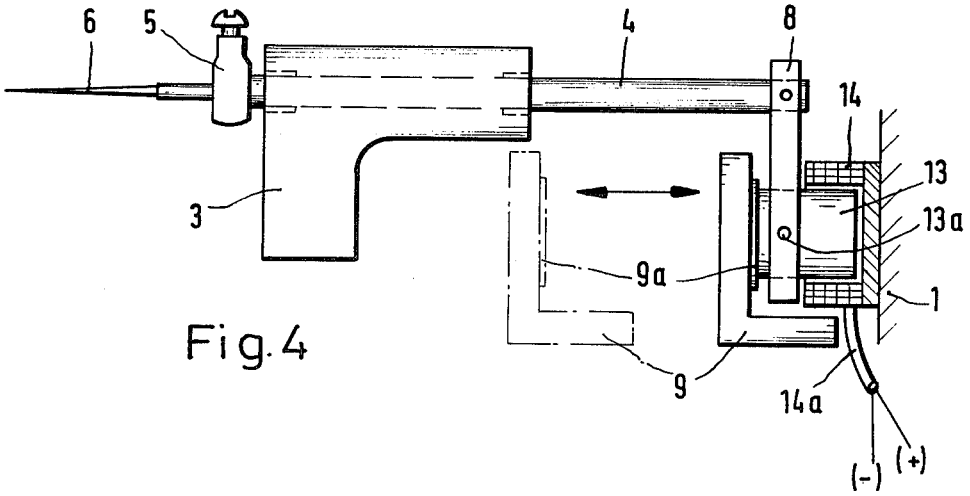
FIG. 4 is a diagrammatic side view of a third embodiment.

The embodiment of FIG. 4 again shows the basic construction of the embroidery machine with the reciprocating drive rail 9 for all needle bars 4, the bars being arranged alongside of each other. In this embodiment, however, each needle bar 4 is coupled to the drive rail 9 provided with counterplates 9*a* by a separate magnet 13 which is developed as a permanent magnet and is fastened to the guide plate 8. In the embodiment shown, this is done by placing the magnet 13 in a corresponding hole in the guide plate 8 in such a manner that the magnet 13 extends slightly out of the guide plate 8 in the direction towards the corresponding counterplate 9*a*. In order to be able to interrupt the continuously acting holding force of the permanent magnet 13, in order to disconnect a needle bar 4 from the drive rail 9, an induction coil 14 is arranged fixed on the machine frame 1, the part of the magnet 13 which extends rearward out of the guide plate 8 protruding into the induction coil 14 in the end position of rest of the needle bar 4, as is shown in FIG. 4. By the induction coil 14 producing a magnetic field which is directed opposite to the magnetic field of the magnet 13, the holding force of the magnet 13 can be eliminated for a brief time. By energizing the induction coil 14, the corresponding needle bar 4 can therefore, despite the permanent holding force of the magnet 13, be disconnected from the drive rail 9 via its guide plate 8. The energizing of the induction coil 14 is effected in accordance with a predetermined program by a two-wire line 14*a*, shown in FIG. 4. FIG. 4 also shows diagrammatically an attachment of the permanent magnet 13, by means of a transverse pin 13*a* on the guide plate 8.

Figure 5:
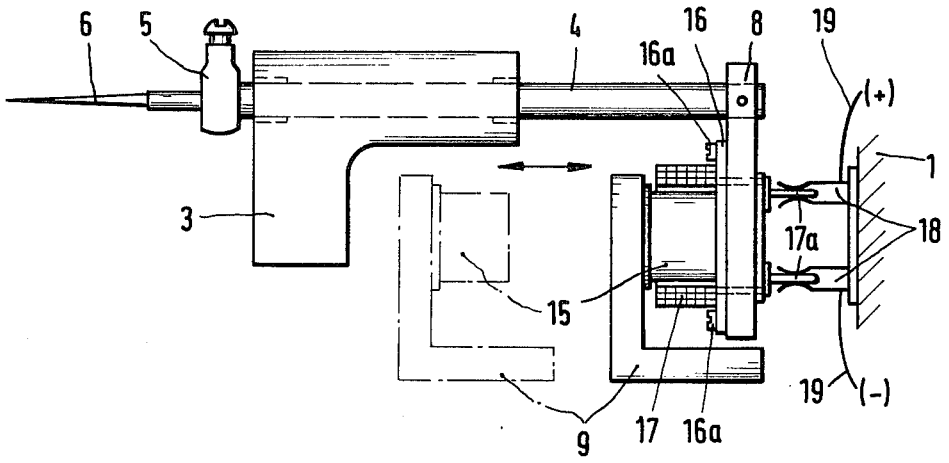
FIG. 5 is a fourth embodiment, also shown in a diagrammatic side view.

In the embodiment shown in FIG. 5, the coupling between the drive rail 9 and the guide plates 8 is effected in each case by a magnet 15, which is again developed as a permanent magnet and is fastened to the drive rail 9. This magnet 15 cooperates with a holding plate 16 which is fastened by screws 16*a* to the guide plate 8. This holding plate 16 at the same time carries an induction coil 17 which, in the end position of rest of the drive rail 9 shown in solid lines in FIG. 5, surrounds the magnet 15. By energizing this induction coil 17 the magnetic holding force of the magnet 15 which is developed as permanent magnet can be eliminated for a short time so that, if necessary, the coupling between the magnet 15 and the holding plate 16 can be disconnected.

The energization of the induction coil 17 which is moved in the coupled condition of the needle bar 4 together with the guide plate 8 of the latter is effected by the program control of the embroidery machine via stationary contact springs 18, each of which is permanently connected by a wire 19 with the program control of the embroidery machine, a contact pin 17*a* of the induction coil 17 engaging into said contact springs in the end position of rest, as can be noted from FIG. 5.

Figure 6:
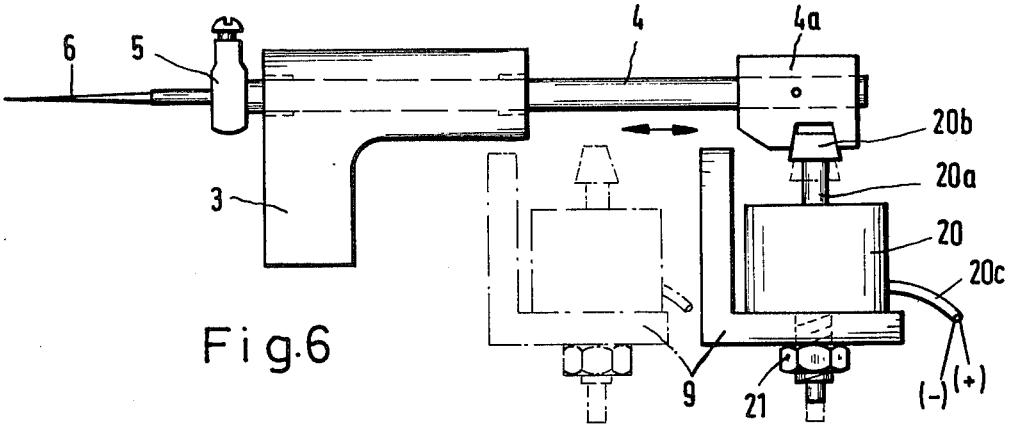
FIG. 6 is a diagrammatic side view of a fifth embodiment.
Figure 7:
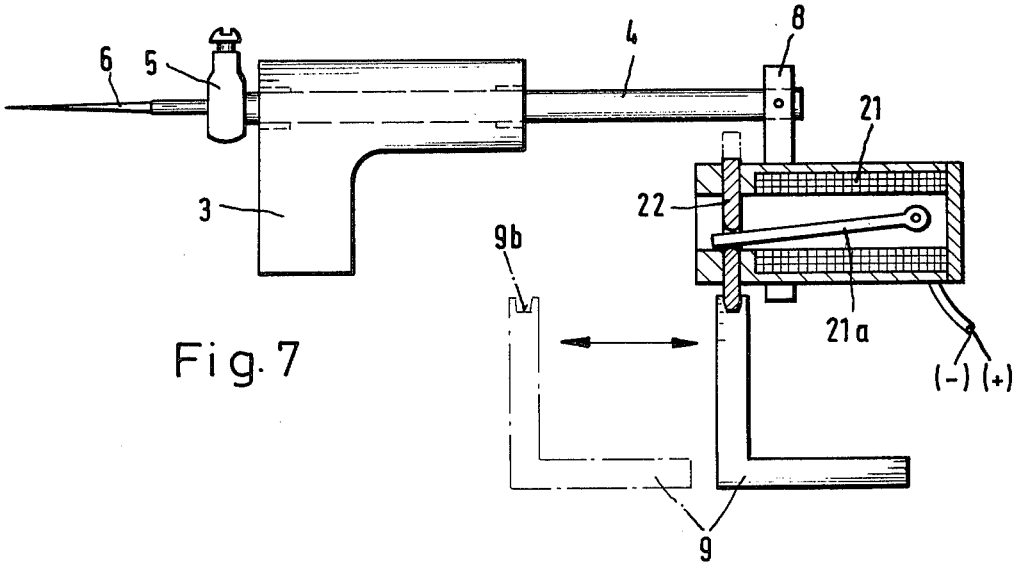
FIG. 7 is a diagrammatic side view of a sixth embodiment.
Figure 8:
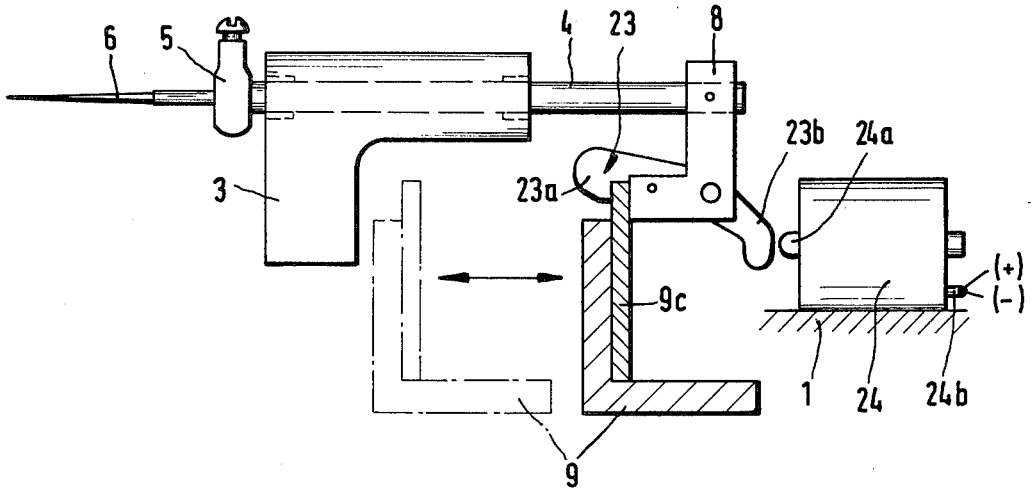
FIG. 8 is a diagrammatic side view of a seventh embodiment.

While in the four embodiments described above the coupling of the needle bar 4 to the drive rail 9 was effected directly by a magnet 11, 12, 13 or 15, developed either as an electromagnet or as a permanent magnet, the embodiments in accordance with FIGS. 6 to 8 show three constructions in which the needle bar 4 can be coupled with the drive rail 9 by a mechanical coupling element which is actuated by a magnet.

In the embodiment shown in FIG. 6, the drive rail 9 carries for this purpose a number of magnets 20 developed as electromagnets. Each magnet 20 is fastened by a nut 21 to the horizontal leg of the angular cross-section drive rail 9 and has a ram 20*a* which bears a coupling member 20*b* on its front end. This coupling member 20*b* cooperates with a complementary frustoconically shaped recess in a driver 4*a* which is fastened to the needle bar 4. The energizing of the magnet 20 is effected by a two-wire line 20*c*.

By energization of the magnet 20 its ram 20*a* is shifted together with the coupling member 20*b* out of the lower position indicated in dot-dash line in FIG. 6 into an upper position shown in solid line, in which the coupling member 20*b* engages into the corresponding recess of the driver 4*a* and couples the corresponding needle bar 4 to the drive rail 9. This coupling process must, to be sure, take place in the rear end position of rest of the needle bars 4 but it takes place within a very short time so that no substantial standstill times for the embroidery machine result upon a change of a program. In order to avoid continuous energization of the magnets 20 in order to maintain one of the two end positions of the ram 20*a*, the magnets 20 can be developed with armature parts stable in both end positions so that a change between the two end positions of the rams 20*a* takes place solely as a result of an electric pulse, without continuous energization of the magnets 20 being necessary.

A preferred embodiment of such a magnet is shown in the embodiment of FIG. 7. This figure shows a magnet 21 which is fastened to the guide plate 8 of the needle bar 4, the magnet having an armature part 21*a* which is stable in both and positions, the armature part being switched solely on the basis of an electric pulse. The armature part 21*a* engages into a coupling pin 22 which pin is displaceably mounted in the magnet 21 and the point of which cooperates with a groove 9*b* in the upper edge of the drive rail 9. In this embodiment also it is possible to switch the armature part 21*a* in the end position of rest of the needle bars 4 by a pulse from the program control of the embroidery machine in order, as desired, to obtain coupling of the corresponding needle bar 4 to the drive rail 9 or to leave the needle bar 4 in the end position of rest.

The last embodiment, shown in FIG. 8, finally shows the mechanical coupling of the individual needle bars 4 with the continuous drive rail 9 in each case by a double-armed pawl 23 supported on the guide plate 8, the pawl arm 23*a* cooperating with a straightedge-like extension 9*c* of the drive rail 9. The corresponding needle bar 4 can be disconnected from the drive rail 9 by swinging the pawl arm 23*a*.

This swinging of the pawl 23*a* is effected by the second arm of the pawl 23, developed as a control lever 23*b*, on which there acts a ram 24*a* of a magnet 24 which is fixed in position on the machine frame 1 and is connected to the control by a line 24*b*. If the ram 24*a* is in the right-hand end position shown in FIG. 1, the needle bar 4 remains coupled via the pawl 23 to the drive rail 9. On the other hand, if the ram 24*a* is moved towards the left by the energization of the magnet 24, it causes a swinging of the pawl 23 when the needle bar 4 moves into the end position of rest. In this way the pawl arm 23*a* is raised and disconnects the needle bar 4 from the drive rail 9.

Figure 9:
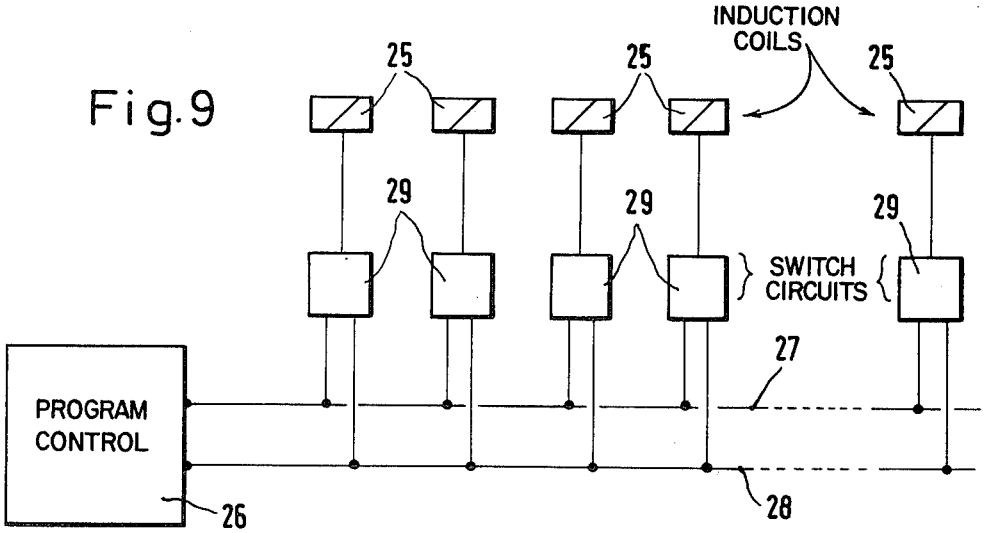
FIG. 9 is a wiring diagram for the supply of the current and control of the magnets.
Figure 10:
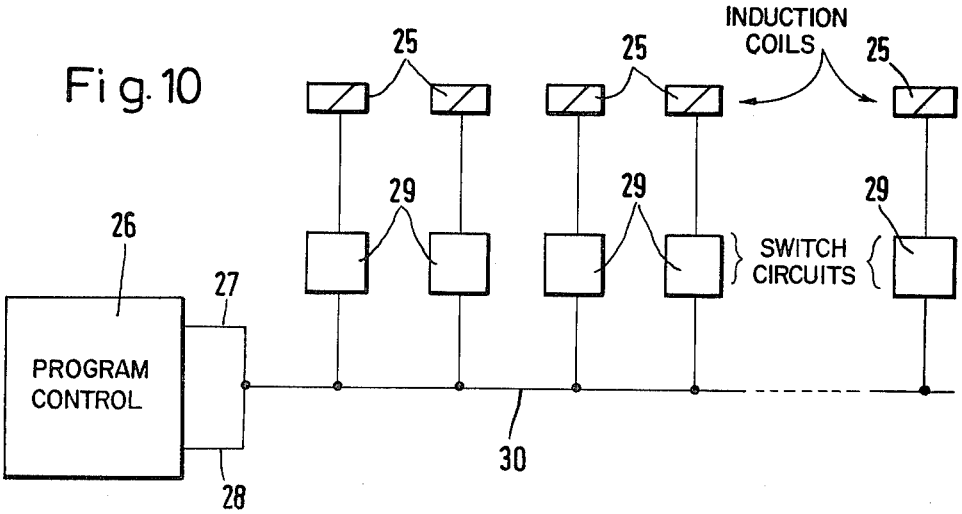
FIG. 10 is an alternative wiring diagram.

The circuit diagrams shown in FIGS. 9 and 10 indicate two possible developments for the power supply and control of the above-mentioned magnets. In both embodiments a plurality of induction coils 25 can be noted. One such induction coil 25 may be the coil of one of the aforementioned electromagnets 11, 12, 20, 21 or 24 or the induction coil 14 or 17 of the above-explained embodiments associated with a permanent magnet 13 or 15. In the embodiment of FIG. 9, the program control, 26, of the embroidery machine is connected on the one hand by an energy line 27 and on the other hand by a control line 28 with frequency-dependent switch circuits 29, each of which is connected in front of an induction coil 25. In this way it is possible to connect all induction coils 25 by a common energy line to the source of energy and to control the energization of the induction coils 25, via the control line 28 common to all switch circuits 29, in accordance with a program sent out by the program control 26. Each frequency-dependent switch circuit 29 has its own response frequency which differs from the others so that via a frequency spectrum fed to the control line 28 only those switch circuits 29, and thus induction coils 25, are controlled which are contained in the corresponding program of the program control 26. Thus in the embodiment of FIG. 9 two lines are sufficient—namely an energy line 27 and a control line 28—to control all induction coils 25 from the program control 26 in accordance with the specific program. The lines 27 and 28 can, for instance, be laid in or on the drive rods 10 so that the control of their induction coils 25 does not afford any difficulty even when the magnets are arranged on reciprocating parts of the embroidery machine.

A further simplification and reduction of the number of lines can be effected in accordance with FIG. 10. In this embodiment, the induction coils 25 and their switch circuits 29 are connected to the program control 26 by a single common energy and control line 30. Over this energy and control line 30 both the energy for the energization of the induction coils 25 and the frequency spectrum which is superimposed on the energy feed are conducted, and it controls the frequency-dependent switch circuits addressed by the specific program.

We claim:

1. In an embroidery machine having a plurality of individual embroidery bars, particularly needle and piercer bars on shuttle embroidery machines, which are mounted for axial displacement independently of each other and are aranged alongside of each other in at least one row, said individual embroidery bars each being adapted to be coupled to a reciprocating drive element in accordance with a program determined by a program control by a magnet means, the improvement comprising:

at least one said magnet means respectively for operatively coupling each said individual embroidery bars to said reciprocating drive element, all said magnet means together including:

one common energy line, one control line connected to said program control, a plurality of induction coils of all said magnet means, respectively, connected to a source of energy via said common energy line, a plurality of frequency-dependent switching circuit means jointly connected to said control line, each of said switching circuit means having its own frequency of response which differs from others of said switching circuit means and being operatively connected with each of said induction coils, respectively, said program control constituting means for sending out the program as a frequency spectrum, said switching circuit means for controlling energization of corresponding of said induction coils via said control line in accordance with the frequency spectrum sent out by said program control.

2. The embroidery machine according to claim 1, wherein said at least one magnet means is arranged directly between a part of said individual embroidery bar and said drive element.

3. The embroidery machine according to claim 1, wherein said at least one magnet means is arranged on said drive element.

4. The embroidery machine according to claim 1, wherein said at least one magnet means is arranged on said individual embroidery bar.

5. The embroidery machine according to claim 3 or 4, wherein said at least one magnet means is an electromagnet.

6. The embroidery machine according to claim 3 or 4, wherein said at least one magnet means is a controllable permanent magnet.

7. The embroidery machine according to claim 5, wherein each said electromagnet is permanently electrically connected with the program control.

8. The embroidery machine according to claim 6, further comprising means for controlling said permanent magnet in an end position of rest of said individual embroidery bar.

9. The embroidery machine according to claim 8, wherein said means for controlling is for eliminating a magnetic holding force of said permanent magnet by generating a magnetic field directed opposite to a magnetic field of said permanent magnet.

10. The embroidery machine according to claim 9, wherein said controlling means comprises, an induction coil at least partially surrounds said permanent magnet and is arranged on said permanent magnet, and means for energizing said induction coil in the end position of rest of said individual embroidery bar.

11. The embroidery machine according to claim 9, comprising wherein said controlling means comprises an induction coil at least partially surrounds said permanent magnet in the end position of rest and said induction coil is arranged fixed in position.

12. The embroidery machine according to claim 1, further comprising mechanical coupling means for connecting each said individual embroidery bar respectively to said drive element via said at least one magnet means, said at least one magnet means is for actuating said mechanical coupling means.

13. The embroidery machine according to claim 12, wherein said at least one magnet means is an elecromagnetic.

14. The embroidery machine according to claim 12, wherein said at least one magnet means is a controllable permanent magnet.

15. The embroidery machine according to claim 12, wherein said at least one magnet means includes an armature part having two stable end positions, said armature part is operatively connected to said mechanical coupling means and adapted to actuate the latter.

16. The embroidery machine according to claims 13, 14 or 15, wherein said at least one magnet means is arranged on the drive element.

17. The embroidery machine according to claims 13, 14 or 15, wherein said at least one magnet means is arranged on said individual embroidery bar.

18. The embroidery machine according to claims 13, 14 or 15, further comprising a machine frame, said at least one magnet means is arranged fixed in position on said machine frame.

19. In an embroidery machine having a plurality of individual embroidery bars, particularly needle and piercer bars on shuttle embroidery machines, which are mounted for axial displacement independently of each other and are arranged alongside of each other in at least one row, said individual embroidery bars each being adapted to be coupled to a reciprocating drive element in accordance with a program determined by a program control by a magnet means, the improvement comprising:

at least one said magnet means respectively for operatively coupling each said individual embroidery bars to said reciprocating drive element, all said magnet means together including:

one common line serving as a common energy line and as a control line connected to said program control, a plurality of induction coils of all said magnet means, respectively, connected to a source of energy via said one common line as the common energy line, a plurality of frequency-dependent switching circuit means jointly connected to said one common line as the control line, each of said switching circuit means having its own frequency of response which differs from others of said switching circuit means and being operatively connected with each of said induction coils, respectively, said program control constituting means for sending out the program as a frequency spectrum, said switching circuit means for controlling energization of corresponding of said induction coils via said control line in accordance with the frequency spectrum sent out by said program control, said common energy line and said control line constitute a single said one common line connecting said magnet means respectively via said induction coils to said program control.

20. In an embroidery machine having a plurality of individual embroidery bars which are mounted for axial displacement independently of each other and arranged alongside of each other in at least one row, said individual embroidery bars each being adapted to be coupled to a reciprocating drive element in accordance with a program determined by a program control, the improvement comprising:

at least one magnet means respectively for operatively coupling each said individual embroidery bars to said reciprocating drive element, a common energy line, a control line connected to said program control, a plurality of induction coils respectively of said magnet means connected to a source of energy via said common energy line, a plurality of frequency-dependent switching circuit means jointly connected to said control line, each of said switching circuit means having its own frequency of response which differs from others of said switching circuit means and being operatively connected with each of said induction coils, respectively, said program control constituting means for sending out the program as a frequency spectrum, said switching circuit means for controlling energization of corresponding of said induction coils via said control line in accordance with the frequency spectrum sent out by said program control.

* * * * *